US007740564B2

(12) United States Patent
Shen

(10) Patent No.: US 7,740,564 B2
(45) Date of Patent: Jun. 22, 2010

(54) STATIONARY EXERCISE APPARATUS

(75) Inventor: Ming-Shan Shen, Taichung (TW)

(73) Assignee: Johnson Health Tech Co., Ltd., Taichung Hsien (TW)

( * ) Notice: Subject to any disclaimer, the term of this patent is extended or adjusted under 35 U.S.C. 154(b) by 11 days.

(21) Appl. No.: 12/157,897

(22) Filed: Jun. 16, 2008

(65) Prior Publication Data

US 2009/0312157 A1 Dec. 17, 2009

(51) Int. Cl.
*A63B 22/04* (2006.01)
*A63B 22/00* (2006.01)

(52) U.S. Cl. ..... 482/52; 482/51

(58) Field of Classification Search ..... 482/51–53, 482/57

See application file for complete search history.

(56) References Cited

U.S. PATENT DOCUMENTS 5,685,804 A 11/1997 Whan-Tong et al.
6,168,552 B1 1/2001 Eschenbach
6,361,476 B1 * 3/2002 Eschenbach ..... 482/52
6,846,273 B1 * 1/2005 Stearns et al. ..... 482/52
7,267,638 B2 * 9/2007 Wang ..... 482/52
7,278,955 B2 * 10/2007 Giannelli et al. ..... 482/51
2007/0238580 A1 * 10/2007 Wang ..... 482/52
2009/0054212 A1 * 2/2009 Wang ..... 482/52
2009/0124463 A1 * 5/2009 Chen ..... 482/52

* cited by examiner

*Primary Examiner*—Steve R Crow

(57) ABSTRACT

The present invention relates to a stationary exercise apparatus having an adjustable assembly connected to the frame for changing the position of the console or the handles. The stationary exercise apparatus comprises a frame, an adjustable assembly which has part of the frame, a moving member pivoted to the frame, a guiding mechanism interconnected the moving member and the frame, and an upright post mounted on the guiding mechanism, a crank unit mounted on the moving member, left and right supporting members respectively connected to the crank unit, left and right swing members respectively connected to the left and right supporting members, and left and right pedals respectively coupled to the left and right supporting members.

9 Claims, 5 Drawing Sheets

STATIONARY EXERCISE APPARATUS

BACKGROUND

1. Field of the Invention

This invention relates to a stationary exercise apparatus, more particularly to a stationary exercise apparatus with an adjustable assembly to change the position thereof.

2. Description of the Related Art

Indoor exercise has become indispensability to people who enjoy exercising. In a variety of indoor stationary exercise apparatus, elliptical or cross-training exercise apparatus have been popular for several years. Early elliptical exercise apparatus typically had a single mode of operation, and exercise intensity was varied by increasing operating speed or resistance. More recently, enhancing exercise intensity in some exercise apparatus has been made by varying the moving path of the user's feet, such as inclining the moving path or increasing the stride length.

Particularly, the elliptical exercise apparatus which use the method of inclining the moving path of the user's feet to enhance exercise intensity usually have a problem. The problem is that makes the user too near or too far away the console or the handles during inclined process. That results in inconvenience for the user to operate the elliptical exercise apparatus. This is because the upright post which is configured for supporting the console or the handles of prior elliptical exercise apparatus is mounted on the stationary frame and can't be adjusted to move forward or rearward.

U.S. Pat. No. 5,685,804 discloses two mechanisms for adjusting the incline of an elliptical exercise apparatus. U.S. Pat. No. 6,168,552 also discloses another elliptical exercise apparatus in which the incline of the moving path of the user's feet can be adjusted. But the console and the handles are mounted on the stationary frame and can't be adjusted according to the incline of the moving path.

Clearly for the forgoing reasons, there is still a need for a stationary exercise apparatus which can make the user to adjust position of the upright post to drive the console or the handles at appropriate location according to the incline of the moving path of the user's feet.

SUMMARY

The present invention relates to a stationary exercise apparatus, which can be inclined to enhance intensity, having an adjustable assembly operably connected to the frame and an upright post mounted on the adjustable assembly for supporting a console or handles. The configuration of the adjustable assembly allows the stationary exercise apparatus to change the position of the upright post. Therefore, the adjustable assembly can keep the console and handles away from the user at an appropriate distance during the inclined process of the moving path.

A stationary exercise apparatus in accordance with the present invention comprises a frame adapted to rest on the floor surface, an adjustable assembly which comprises part of the frame, a moving member having a first portion connected to the part of the frame and a second portion, a guiding mechanism having a first elongate member connected to the second portion of the moving member and a guiding member interconnected the first elongate member and the frame, and an upright post mounted on the adjustable assembly. The stationary exercise apparatus also comprises a crank unit coupled to the moving member of the adjustable assembly, left and right supporting members having rear ends and front ends respectively connected to the crank unit to rotate about the crank unit, left and right swing members having upper portions connected to the rear of the frame and lower portions respectively connected to the rear ends of the pair of supporting members, and left and right pedals respectively coupled to the supporting members.

In one embodiment of the present invention, the guiding member is a second elongate member. One of the end portions of the second elongate member are pivoted to the front of the frame and the other end portion of the second elongate member pivoted to the first elongate member. And the first elongate member, the second elongate member, the front of the frame and the moving member are configured in a substantial parallelogram shape. As adjusting the moving member to transform the appearance of the parallelogram, such as rotating the moving member upwardly, then the upright post, the handles and the pedals can be driven to move forward and upward simultaneously.

These and other features, aspects, and advantages of the present invention will become better understood with reference to the following description and claims.

DETAIL DESCRIPTION

Figure 1:
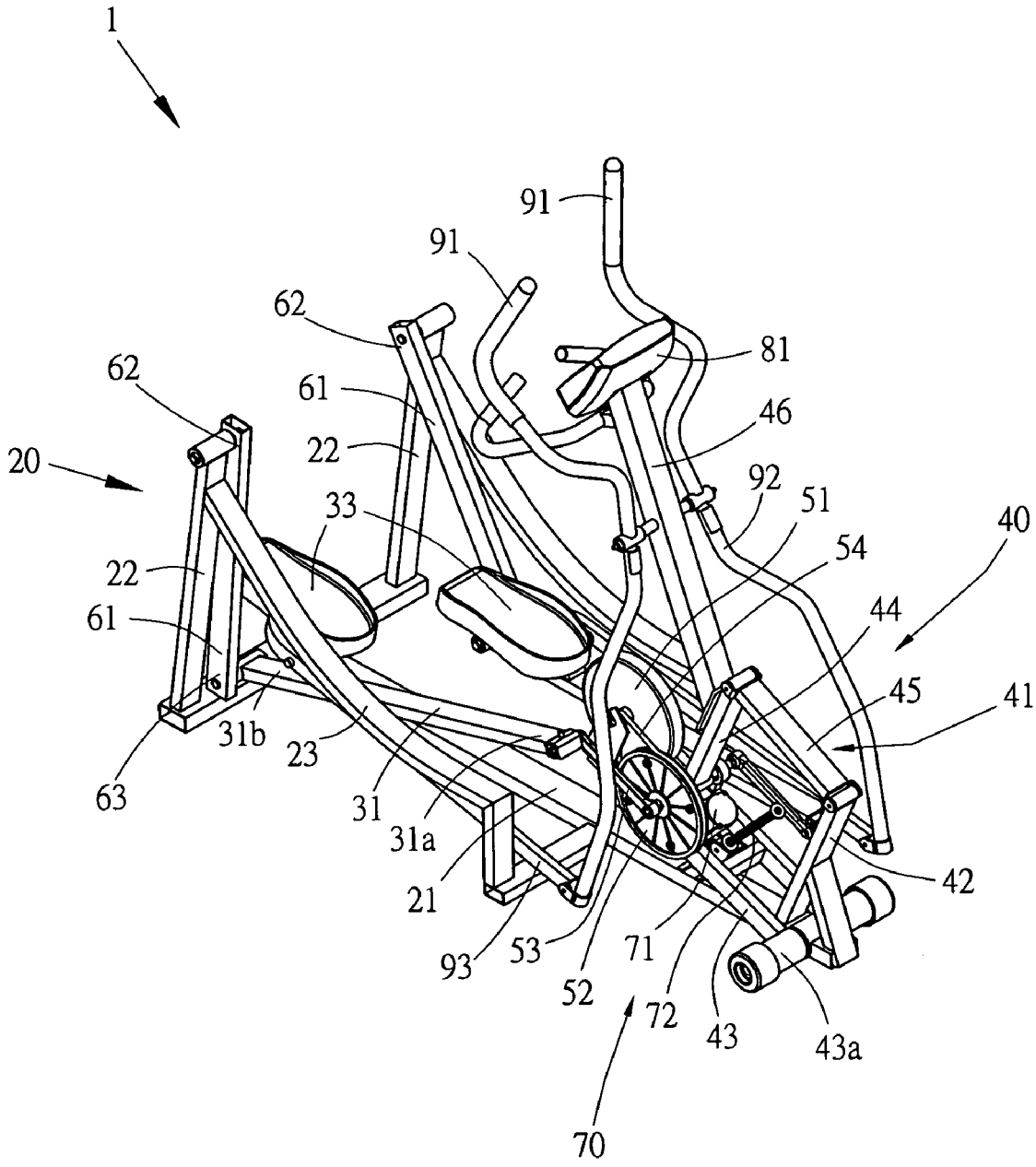
FIG. 1 is a perspective view of a stationary exercise apparatus according to a preferred embodiment of the present invention.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

FIG. 1 illustrates an embodiment of a stationary exercise apparatus 1 having a frame 20 adapted to rest on the floor surface and to provide a foundation for other mechanisms to couple thereto. The frame 20 has a base 21, left and right braces 22 mounted at the rearward of the base 21, and left and right arc members 23 respectively mounted between the base 21 and the left and right braces 22 for increasing the stability and rigidity of the frame 20.

Figure 2:
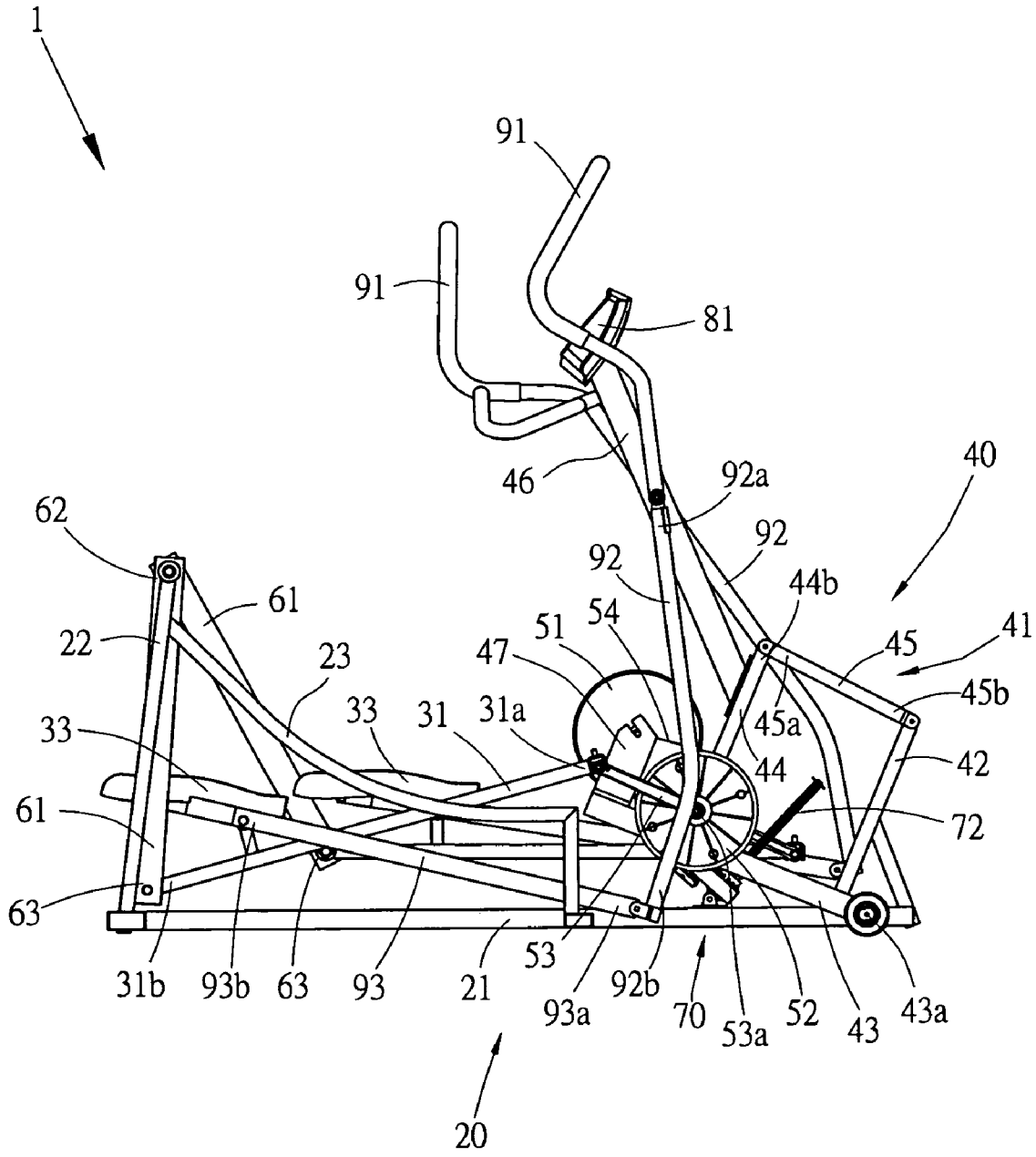
FIG. 2 is a side view of the stationary exercise apparatus of FIG. 1.
Figure 3:
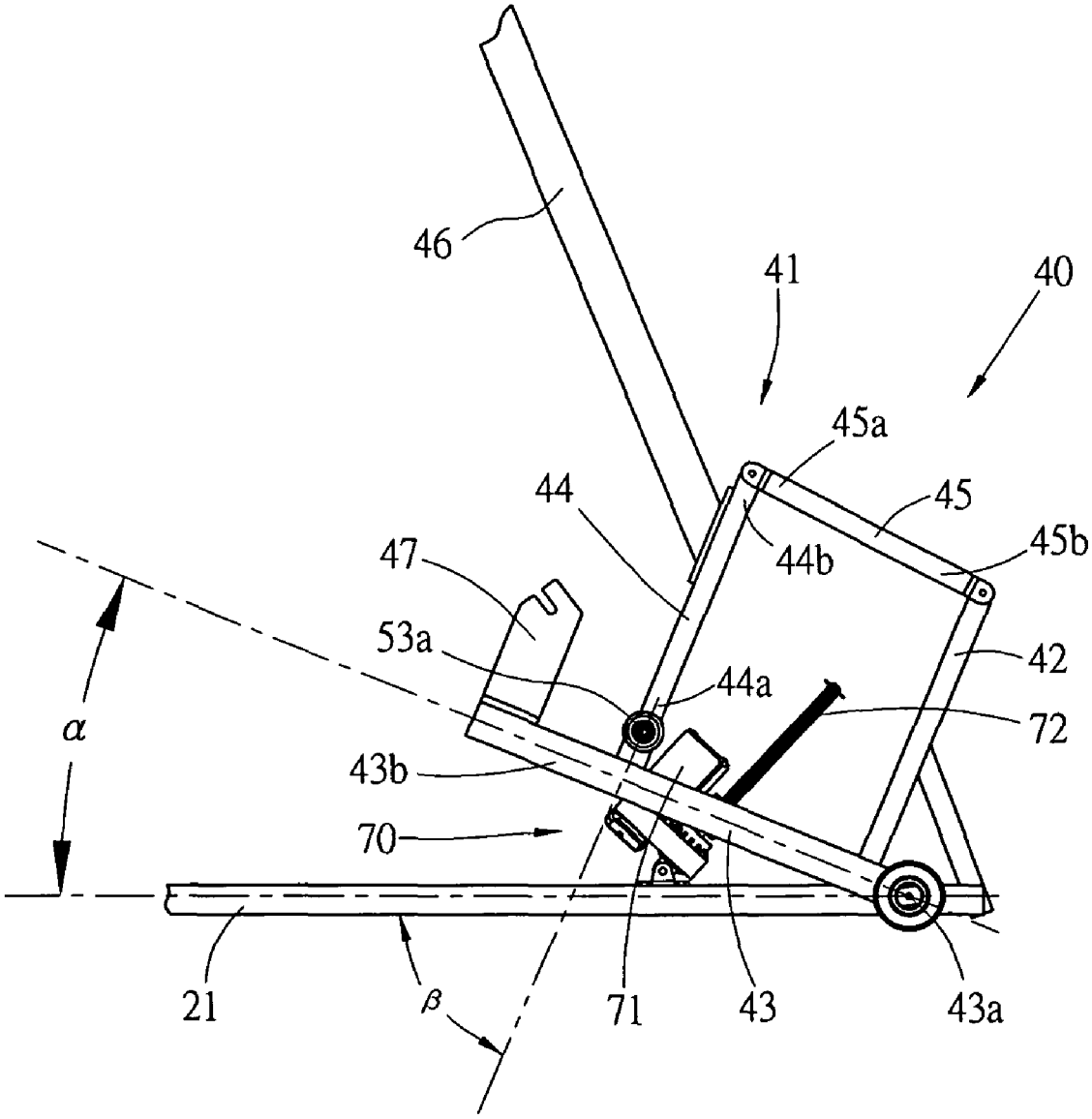
FIG. 3 is a side view of part structure of the stationary exercise apparatus of FIG. 2.

Depicted in FIG. 2 and FIG. 3, an adjustable assembly 40 is connected to the front of the base 21. In the illustrated embodiment, the adjustable assembly 40 comprising front part of the base 21 of the frame 20, a moving member 43, a guiding mechanism 41, and an upright post 46. The moving member 43 has a first portion 43*a* pivoted to the front of the base 21 and a second portion 43*b*. And the moving member 43 has a degrees with respect to the base 21. At the second portion 43*b* of the moving member 43, there are a bracket 47 and a crank unit 53 which has an axle 53*a* pivotally mounted thereon. By pivoting to the base 21 laterally, the moving member 43 can be rotated in a vertical plane. The guiding mechanism 41 comprises a first elongate member 44, and a guiding member. In this preferred embodiment, the guiding member is a second elongate member 45 to achieve the guiding function for the second end portion 44*b* of the first elongate member 44. Both the first elongate member 44 and the second elongate member 45 have a first end portion 44*a*/45*a* and a second end portion 44*b*/45*b*. As shown in FIG. 3, the first end portion 44*a* of the first elongate member 44 is pivoted coaxially to the axle 53*a* of the crank unit 53. The second end portion 44*b* of the first elongate member 44 is pivoted to the first end portion 45*a* of the second elongate member 45. And the second end portion 45*b* of the second elongate member 45 is pivoted to the frame 20. In the preferred embodiment, there is a sustaining member 42 which extends upwardly from the front of the base 21 of the frame 20 in a predetermined inclined angle. At the distal end of the sustaining member 42 of the frame 20, the second end portion 45*b* of the second elongate member 45 is pivoted thereto. Therefore, the moving member 43, the guiding mechanism 41, and the sustaining member 42 form as an approximate parallelogram shape as shown in FIG. 3. And the first elongate member 44 has β degrees with respect to the base 21 of the frame 20. Alternatively, there are several ways of performing the same guiding function as present embodiment, such as pivoting rollers or sliders to the second end portion 45*b* of the second elongate member 45 for sliding at a predetermined track on the frame. Or people skilled in the art can directly pivot the rollers or sliders to the second end portion 44*b* of the first elongate member 44 and make the second end portion 44*b* of the first elongate member 44 to move on a track or a rail. For simplicity, all such alternatives are referred to herein as guiding member for performing guiding function to guide the second end portion 44*b* of the first elongate member 44.

Referring to FIG. 2, there is a pulley 52 coaxially pivoted to the axle 53*a* of the crank unit 53 and a fly wheel 51 pivotally mounted to the bracket 47. A belt 54 is wound onto the pulley 52 and the fly wheel 51. When the moving member 43 is adjusted to rotate, the pulley 52 and the fly wheel 51 moves simultaneously. The upright post 46 of the adjustable assembly 40 is mounted on the first elongate member 44. The upright post 46 moves together with the first elongate member 44 as the moving member 43 rotating.

Referring to FIG. 3, in order to adjust the moving member 43 automatically, the stationary exercise apparatus 1 comprising a driving mechanism 70 interconnected the moving member 43 and the base 21. The driving mechanism 70 has a motor 71 coupled to the base 21 and a screw rod 72 engaged with the moving member 43 and the motor 71. The motor 71 can drive the screw rod 72 to rotate and thereby lift or lower the moving member 43 about the first portion 43*a* which is pivoted to the base 21. As the moving member 43 is lifted, the α degrees increase. However, as described above, due to the parallelogram, the first elongate member 44 maintains parallel to the sustaining member 42 during the moving member 43 rotating. Therefore, the β degrees remain substantially constant during the lifting or lowering process.

Please referring to FIG. 1, the stationary exercise apparatus 1 comprises left and right supporting members 31, left and right swing members 61, and left and right pedals 33. Each of the left and right swing members 61 has a lower portion 63 and an upper portion 62 pivoted to the respective brace 22 of the frame 20. Each of the supporting members 31 has a front end 31*a* and a rear end 31*b*. The front ends 31*a* of the left and right supporting members 31 respectively connect to the crank unit 53. And the rear ends 31*b* respectively connect to the lower portions 63 of the left and right swing members 61. Left and right pedals 33 respectively coupled to the left and right supporting members 31.

The stationary exercise apparatus 1 further comprises a console 81 mounted on the upper portion of the upright post 46 for the user to control the stationary exercise apparatus 1.

Referring to FIG. 1 and FIG. 2, the stationary exercise apparatus further comprises left and right handles 91, left and right handle links 92 and left and right control links 93. The left and right handles 91 are respectively pivotally connected to the left and right side of the upright post 46 for the user to grip as exercising. Each of the left and right control links 93 has a front portion 93*a* and a rear portion 93*b*. In the embodiment, the rear portions 93*b* of the left and right control links 93 are respectively connected to the left and right supporting members 31. Each of the left and right handle links 92 has an upper portion 92*a* and a lower portion 92*b*. The lower portions 92*b* of the left and right handle links 92 are respectively connected to the front portions 93*a* of the left and right control links 93. The upper portions 92*a* of the left and right handle links 92 are respectively pivotally connected to the left and right handles 91 and moves with the left and right handles 91. As mentioned above, the upright post 46 can be driven to move. So, the left and right handles 91 and the console 81 move simultaneously as the upright post 46 moving.

Please referring to FIG. 3, as described above, the moving member 43, the guiding mechanism 41 and the sustaining member 42 form as an approximate parallelogram. Therefore, in the preferred embodiment, the first elongate member 44 is pivotally constrained by the moving member 43 and the second elongate member 45 for paralleling to the sustaining member 42 which is fixed on the base 21. In other words, the substantially constant β degrees mean that the first elongate member 44 does not significantly rotate during the lifting or lower process. More specifically, if the sustaining member 42 is conceptualized as a virtual line which links the second end portion 45*b* of the second member 45 and the base 21 in a predetermined incline angle and not limited to a concrete matter, such as a lever, as long as the first elongate member 44 parallel to the virtual line, the β degrees maintain substantially constant. Thus, there are several equivalent structures to perform the same function as making the first elongate member 44 does not rotate. Also, the first elongate member 44 is pivoted coaxially to the axle 53*a* of the crank unit 53. The characteristic of making the first elongate member 44 to maintain at substantially constant degrees with respect to the base 21 can keep the upright post 46 and the crank unit 53 having the same displacement during the lifting or lower process.

Figure 4:
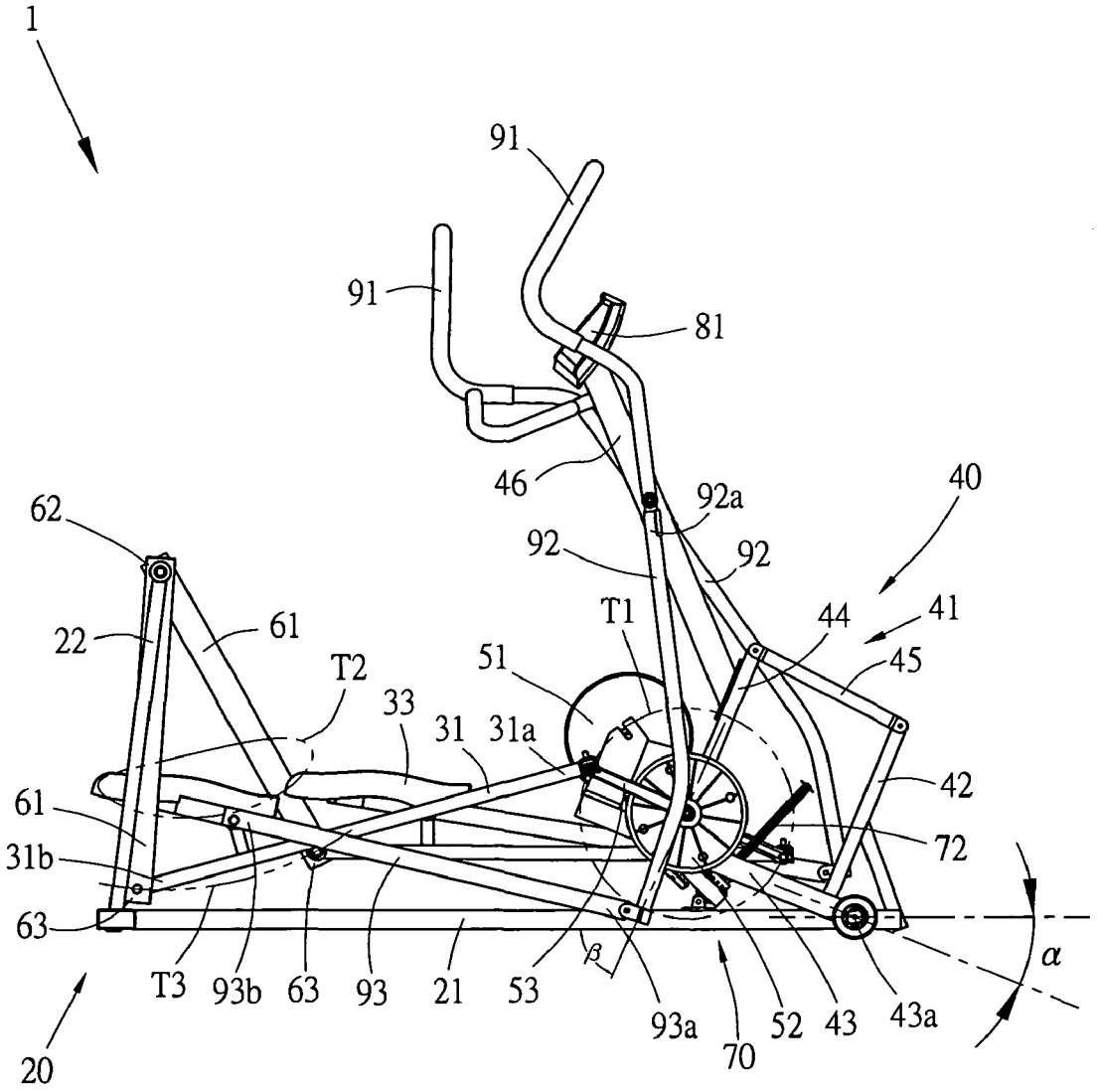
FIG. 4 is a side view of the stationary exercise apparatus in a first status.
Figure 5:
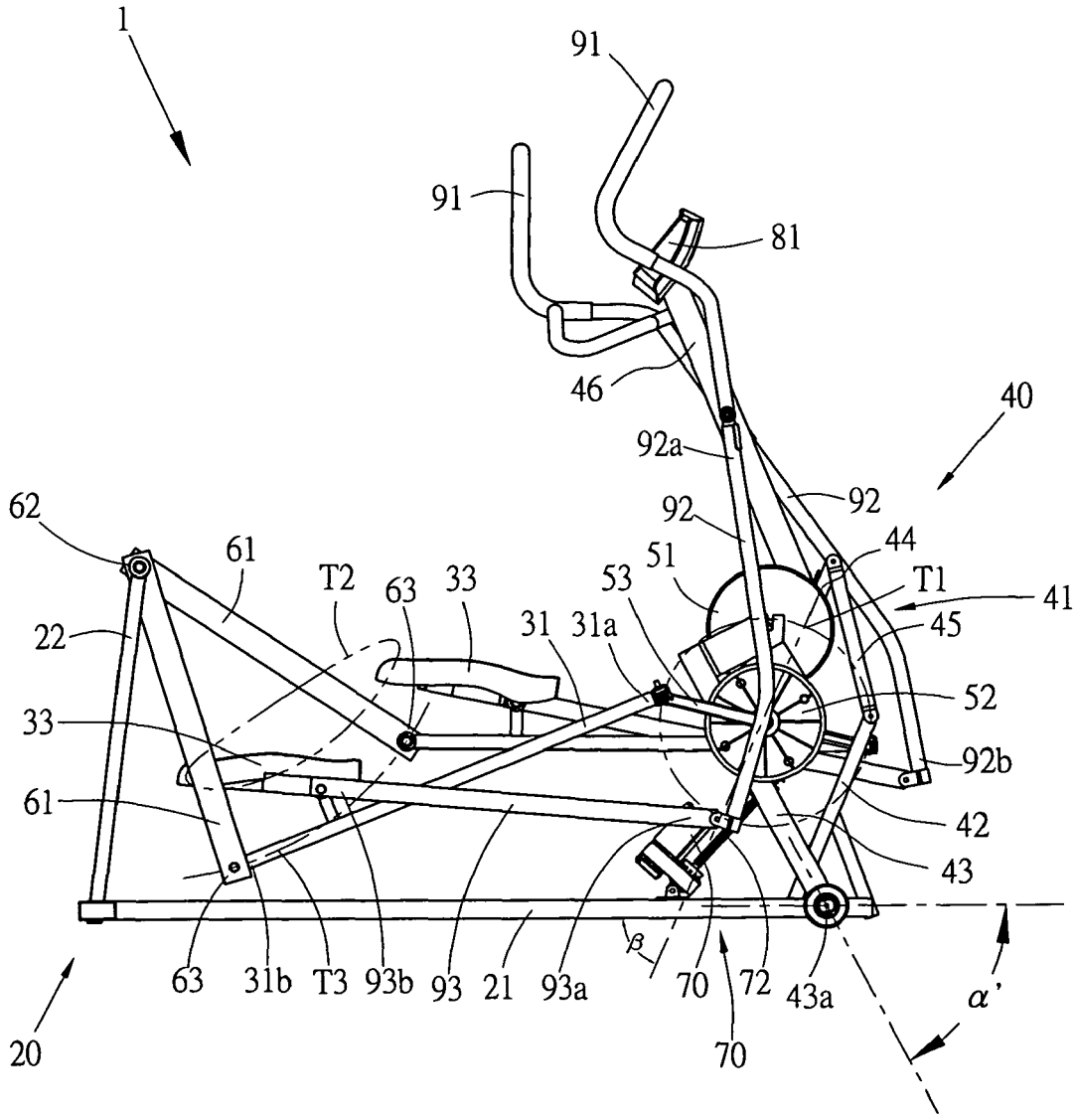
FIG. 5 is a side view of the stationary exercise apparatus in a second status relative to FIG. 4.

Please referring to FIG. 4 and FIG. 5, the left and right arc members 23 are removed for clearly observing. FIG. 4 is the moving member 43 at a first status relative to FIG. 5. At the first status, the crank unit 53, the pulley 52 and the fly wheel 51 are all at a relative lower position. The circle paths T1 are the rotation trajectories of the crank unit 53 and also at a relative lower position. The α degrees of the moving member 43 with respect to the base 21 are at a relative small value. The left and right supporting members 31, left and right swing members 61, left and right pedals 33 and left and right handles 91 all indirectly move with the moving member 43. Therefore, at the first status, the left and right swing members 61 and the swinging paths T3 thereof are at a relatively lower position. The exercising paths T2 of the left and right pedals 33 are also at a relative lower position and have a small amount of incline.

FIG. 5 is the moving member 43 at a second status. At the second status, the moving member 43 is adjusted to rotate upwardly by the driving mechanism 70. The α degrees are increased to a α' degrees which are large value compared to the first status. Depicted in FIG. 5, the crank unit 53, the pulley 52 and the fly wheel 51 are at a relative higher and more front position than the first status thereof. From FIG. 5, it is clearly to find the circle paths T1 are higher and more front at the second status than the first status. With the crank unit 53 being driven to the second status, the front ends 31*a* of the left and right supporting members 31 are pulled to higher and more front positions relative to the first status. The rear ends 31*b* of the left and right supporting members 31 are also pulled upward and forward. Simultaneously, the left and right supporting members 31 pull respective left and right swing members 61 to rotate about the upper portions 62 thereof forward relative to the base 21. The pulling actions increase the amount of incline more than the first status. The swinging paths T3 then become more incline. And the exercising paths T2 of the left and right pedals 33 also become more incline. Hence, the user can increase the exercising intensity by adjusting the moving member 43 to change the amount of incline of the exercising paths T2.

Still referring to FIG. 4 and FIG. 5, the parallelogram in FIG. 4 become a rhombus-liked shape in FIG. 5. As mentioned above, the first elongate member 44 of the guiding mechanism 41 remain at substantially constant β degrees with respect to the base 21. Therefore, as the moving member 43 rotated upward, the upright post 46 also moves upward and forward. More specifically, the parallelogram shape which are structured by the moving member 43, the guiding mechanism 41, and the sustaining member 41 makes the upright post 46 moves at the same direction with the moving member 43. When the upright post 46 being moved upward and forward, the console 81 and the left and right handles 91 are also driven to move at the same direction. Because the first elongate member 44 is pivoted coaxially to the axle 53*a* of the crank unit 53, the displacement of the upright post 46 is also the same with the crank unit 53. Besides, the console 81 and the left and right handles 91 also have the same displacement with the crank unit 53. Hence, during the moving member 43 adjusting process, such as the first status in FIG. 4 to the second status in FIG. 5, the console 81 and the handles 91 can be kept at an appropriate distance and angle with respect to the user. In the preferred embodiment, the user does not become too closer to the console 81 or the handles 91 when he/she adjusts the amount of incline of the exercising paths T2.

The preferred embodiment does not require that all the advantageous features and all the advantages described need to be incorporated into every embodiment thereof. Although the present invention has been described in considerable detail with reference to certain preferred embodiments thereof, other embodiments are possible. Therefore, the spirit and scope of the appended claims should not be limited to the description of the preferred embodiment contained herein.

What is claimed is:

1. A stationary exercise apparatus, comprising:

(a) a frame;

(b) a moving member having a first portion pivoted to the frame and a second portion, wherein the moving member can be adjusted to rotate about the first portion for changing position relative to the frame;

(c) a guiding mechanism having a first elongate member and a second elongate member, each of the first elongate member and the second elongate member having a first end portion and a second end portion, the first end portion of the first elongate member pivoted to the second portion of the moving member and the second end portion thereof pivoted to the first end portion of the second elongate member, the second end portion of the second elongate member pivoted to the frame;

(d) an upright post having a upper portion and a lower portion mounted on the guiding mechanism;

(e) a crank unit coupled to the second portion of the moving member;

(f) left and right supporting members, the supporting members having front ends respectively connected to the crank unit for rotating relatively along the crank unit and rear ends;

(g) left and right swing members, the swing members having upper portions connected to the frame and lower portions respectively connected to the rear ends of the left and right supporting members; and (h) left and right pedals respectively coupled to the supporting members.

2. The stationary exercise apparatus of claim 1, the stationary exercise apparatus further comprising a driving mechanism interconnected between the frame and the moving member for driving the moving member to change position.

3. The stationary exercise apparatus of claim 2, the driving mechanism comprising a motor coupled to the frame and a screw rod engaged with the moving member and the motor.

4. The stationary exercise apparatus of claim 1, the stationary exercise apparatus further comprising a console unit mounted on the upper portion of the upright post.

5. The stationary exercise apparatus of claim 4, wherein the console is moved forward when the moving member is adjusted to move forward.

6. The stationary exercise apparatus of claim 1, the stationary exercise apparatus further comprising left and right handles respectively pivotally connected to the upright post.

7. The stationary exercise apparatus of claim 6, wherein the pair of handles are moved forward when the moving member is adjusted to move forward.

8. The stationary exercise apparatus of claim 1, wherein the first elongate member of the guiding mechanism is pivotally constrained by the moving member and the second elongate member to maintain a substantially constant angle with respect to the frame when the moving member is adjusted to move.

9. The stationary exercise apparatus of claim 1, the crank unit having an axle pivotally mounted on the second portion of the moving member, and the first elongate member of the guiding mechanism coaxially pivoted to the axle of the crank unit.

* * * * *